United States Patent [19]

Oishi et al.

[11] Patent Number: 4,836,819

[45] Date of Patent: Jun. 6, 1989

[54] SKATEBOARDING TOY

[75] Inventors: Shingo Oishi; Shohta Nishizawa, both of Tokyo, Japan

[73] Assignee: Iwaya Corporation, Tokyo, Japan

[21] Appl. No.: 196,689

[22] Filed: May 20, 1988

[30] Foreign Application Priority Data

Dec. 2, 1987 [JP] Japan ..... 62-305256

[51] Int. Cl.[4] ..... A63H 17/25; A63H 11/00

[52] U.S. Cl. ..... 446/288; 446/353; 446/437

[58] Field of Search ..... 446/279, 280, 288–292, 446/286, 269, 354, 353, 352, 437, 460

[56] References Cited

U.S. PATENT DOCUMENTS 2,885,823 5/1959 Smith, Jr. ..... 446/288 X
4,422,261 12/1983 Kozuka et al. ..... 446/290

FOREIGN PATENT DOCUMENTS 897336 5/1962 United Kingdom ..... 446/280
2186501 8/1987 United Kingdom ..... 446/279

*Primary Examiner*—Mickey Yu
*Attorney, Agent, or Firm*—James E. Nilles; Donald C. McGaughey

[57] ABSTRACT

A skateboarding toy, wherein a mechanism frame adapted to support a toy body horizontally and rotatably is erected on a skateboard having a drive wheel and front steering wheels, and a steering rod for operating the front wheels is provided. When the drive wheel is driven, the toy body with the skateboard is advanced in a straight direction and when the steering rod is moved back and forth, the front wheels are turned horizontally toward the right and left alternately with respect to the advancing direction of the skateboard, so that the skateboard runs along a snaking path.

6 Claims, 5 Drawing Sheets

SKATEBOARDING TOY

BACKGROUND OF THE INVENTION

1. Field of the Invention

The present invention relates to a skateboarding toy and more particularly to a skateboarding toy in which a toy animal performs skateboarding.

2. Description of the Prior Art

Various types of moving toys are available most of these toys a toy body formed in the likeness of an animal is so constructed as to perform a variety of actions or play musical instruments. The conventional moving toys amuse the user by their interesting motions and so far there have been no moving toys available that actually ride on the skateboard and performs skateboarding actions.

SUMMARY OF THE INVENTION

An object of this invention is to provide an interesting skateboarding toy in which a toy body or toy animal rides on a skateboard and moves its body to keep a balance on the skateboard as if it were actually playing and enjoying the skateboarding.

The skateboarding toy according to this invention comprises: a skateboard having a drive wheel and front steering wheels; a mechanism frame erected on the skateboard at the central portion, the mechanism frame being enclosed by a toy body, the mechanism frame being adapted to support the toy body horizontally and rotatably; a first actuating arm rotatably supported on the mechanism frame to steer the front wheels through a steering rod; a second actuating arm rotatably supported on the mechanism frame for oscillating the toy body; and an output mechanism installed in the mechanism frame for driving the first and second actuating arms and at the same time driving the drive wheel.

In the skateboarding toy according to this invention, the output mechanism drives the drive wheel and at the same time oscillates the first actuating arm about its support shaft, which in turn causes the second actuating arm to be oscillated.

As the wheel is driven, the skateboard on which the toy body is mounted sideways is advanced in a straight direction.

When the first actuating arm is oscillated, the actuating portion at the lower end of the first actuating arm intermittently pushes the steering rod to be slowly advanced or retracted. As the steering rod is moved back and forth, the front wheels are slowly turned horizontally toward the right and left alternately with respect to the advancing direction of the skateboard.

The drive wheel tends to advance the skateboard straight ahead and the front wheels are turned horizontally toward the right and left alternately by the steering rod. As a result of the combined action of the drive wheel and the front wheels, the skateboard runs along a snaking path.

As the first actuating arm is oscillated, the second actuating arm is also oscillated. The oscillation of the second arm causes the toy animal to slowly turn horizontally to the right and left alternately. To describe in more detail, when the toy body is rotated toward the right, the front wheels are steered toward the right causing the skateboard to turn to the right. When the toy body is rotated to the left, the front wheels are steered toward the left turning the skateboard to the left. The above right and left steering is repeated.

In this way, the toy body riding sideways on the skateboard twists the upper half of its body while the skateboard is being steered to the right and left. This action makes the toy body look as if it were keeping a balance on the skateboard by manipulating the skateboard.

In the following, we will describe these and other objects and features of this invention by referring to the attached drawings.

DESCRIPTION OF THE PREFERRED EMBODIMENT

Figure 1:
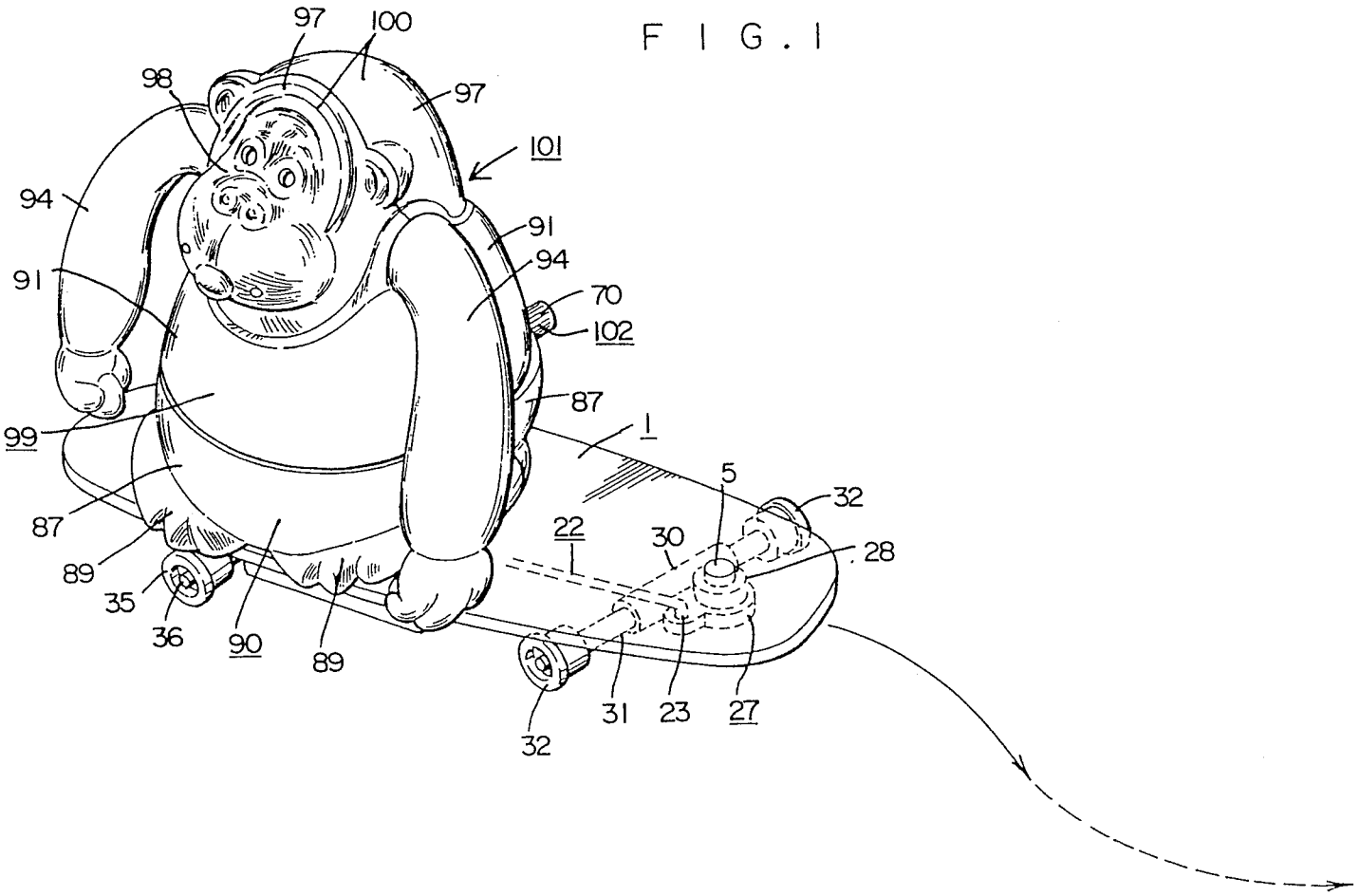
FIG. 1 is a perspective view of a skateboarding toy.
Figure 2:
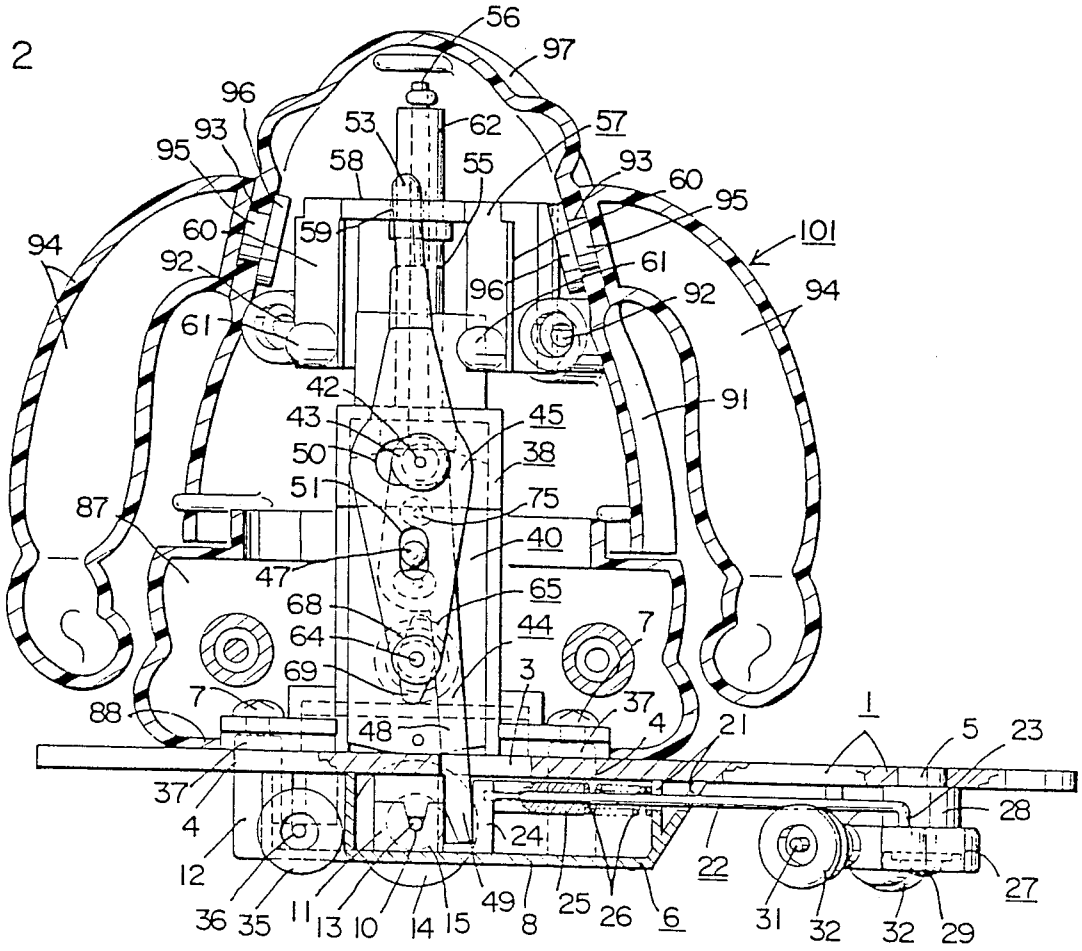
FIG. 2 is a side view of the skateboarding toy showing the internal mechanism on one side.
Figure 3:
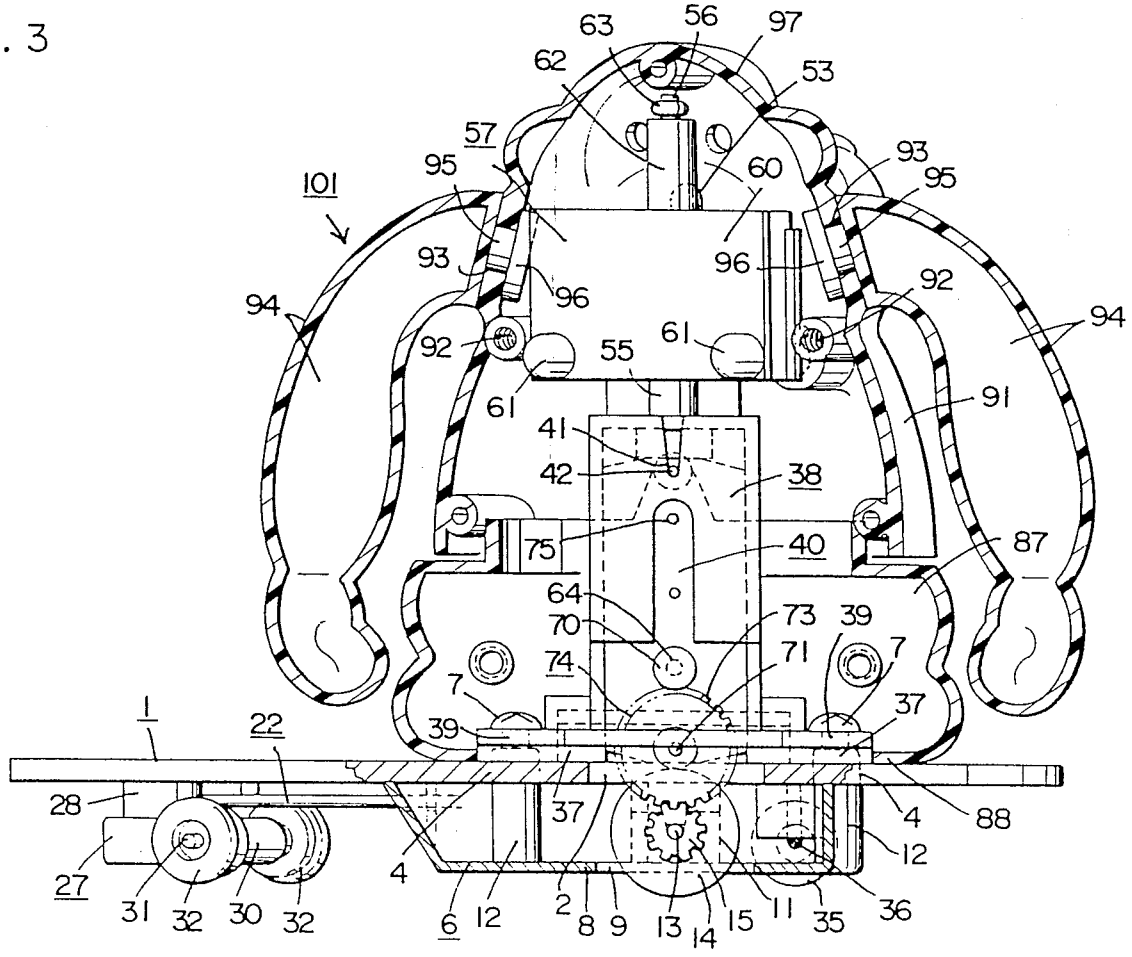
FIG. 3 is a side view of the skateboarding toy showing the internal mechanism on the other side.
Figure 4:
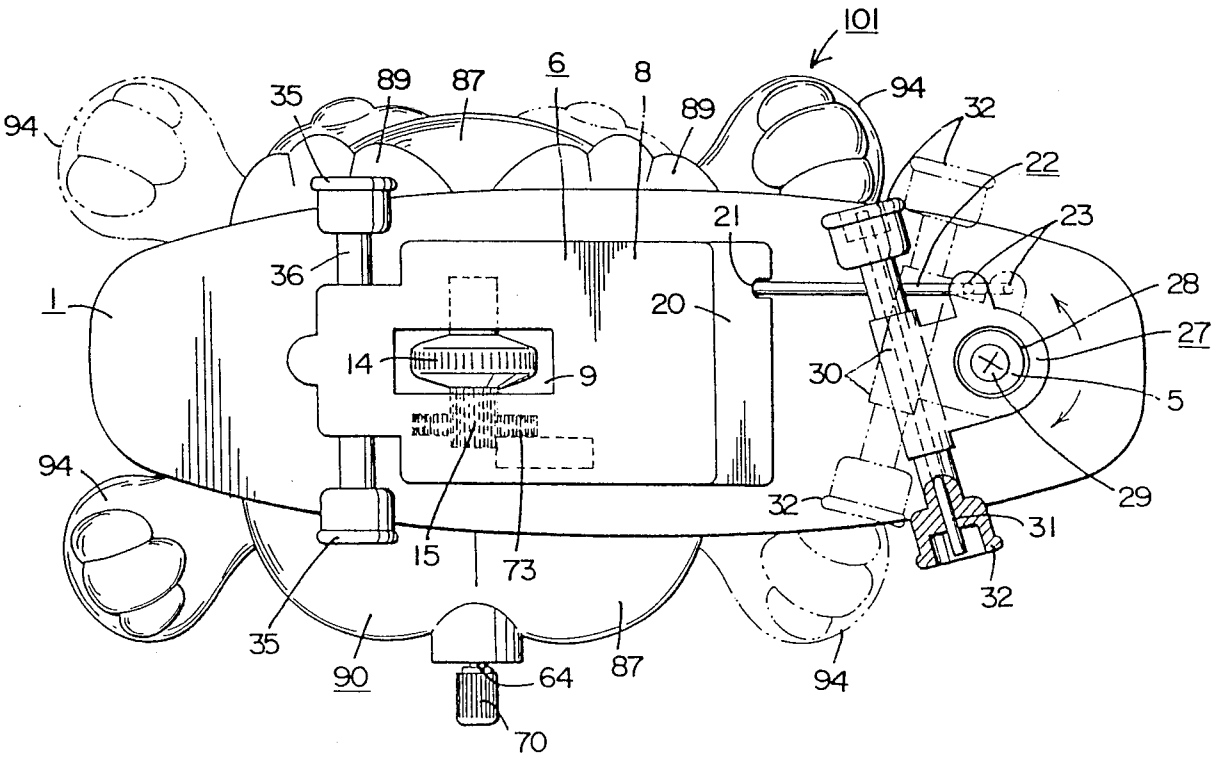
FIG. 4 is a bottom view of the toy.
Figures 5, 6:
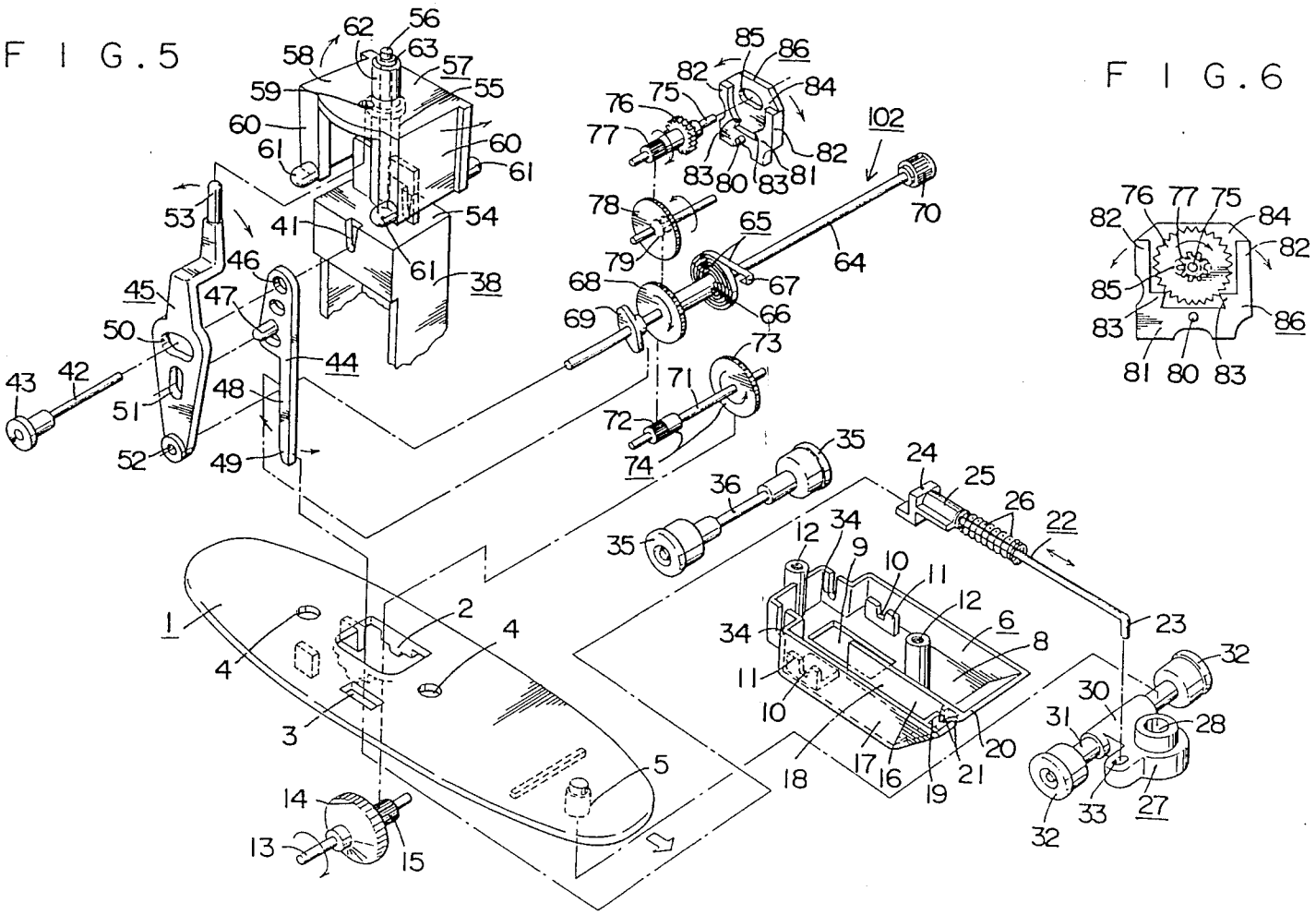
FIG. 5 is an exploded perspective view showing the internal mechanism of the toy.
FIG. 6 is a side view of the braking mechanism of the toy.

In the figures, reference numeral 1 represents a skateboard. The skateboard 1 has an insertion opening 2 at a position slightly deviated from the center to one side. Near one lateral side of the insertion opening 2 a long guide slot 3 is formed longitudinally in the skateboard 1. Also formed in the skateboard 1 are holes 4, 4 near the front and rear of the insertion opening 2. On the underside of the skateboard 1 near the front end a cylindrical boss 5 is projected.

At the insertion opening 2 a wheel case 6 is securely attached to the skateboard 1 from under by screws 7, 7 that are inserted through the holes 4, 4.

The wheel case 6 has a longitudinally elongate wheel guide opening 9 in a bottom plate 8 at a position corresponding to the insertion opening 2. On each lateral side of the wheel guide opening 9, a pair of bearing pieces 11, 11 with recesses 10, 10 is formed integral with the bottom plate 8. On the longitudinally front and rear side of the wheel guide opening 9, screw cylinders 12, 12 into which the screws 7, 7 are engaged are erected from and formed integrally with the bottom plate 8.

Rotatably supported on the pair of bearing recesses 10, 10 are the ends of a wheel shaft 13, to an intermediate portion of which a wheel 14 that rotates and partly projects down from the wheel guide opening 9 is securely mounted. The wheel shaft 13 also has a drive gear 15 secured thereto near the wheel 14. A partition wall 16 is erected on the bottom plate 8 near and facing one side wall 17 of the wheel case 6. The partition wall 16 and the side wall 17 form a chamber 18. Guide holes 21 are formed in a front partition wall 19 of the chamber 18 and in a front wall 20 of the wheel case 6. A steering rod 22 is installed in the chamber 18 and in the guide holes 21 so that it can be advanced or retracted. The steering rod 22 has its front portion bent to form an engagement portion 23 and its base portion secured with an L-shaped engagement piece 24. The ends of a coil spring 26 wound on the steering rod 22 are engaged with a mounting shaft 25 of the engagement piece 24 and with the front partition wall 19.

A movable frame 27 is sleeved over the boss 5 of the skateboard 1 through a vertical bearing 28 so that it can rotate horizontally. The movable frame 27 is prevented from coming off the boss 5 by a screw 29 that is screwed into the boss 5 from under the vertical bearing 28. The movable frame 27 has a horizontal bearing 30 projecting from one side thereof, through which a wheel shaft 31 is rotatably passed and supported and has front wheels 32, 32 at each end. The movable frame 27 also has an engagement hole 33 formed near the vertical bearing 28. The engagement portion 23 of the steering rod 22 is inserted into the engagement hole 33. The skateboard toy can run with the front wheels 32, 32 on each side and the wheel 14. At the rear part of the wheel case 6 a pair of bearing recesses 34, 34 is formed to rotatably support a wheel shaft 36 that has rear wheels 35, 35 at each end.

A gear case holder 38 as a mechanism frame has front and rear mounting pieces 39, 39 at the lower portion thereof. The front and rear mounting pieces 39, 39 are fastened to the skateboard 1 through spacers 37, 37 by the screws 7, 7 so that the lower portion of a gear case 40—accommodated as a mechanism frame in the gear case holder 38—is inserted in the insertion opening 2. The gear case holder 38 has insertion holes 41 which are arranged longitudinally with respect to the toy figure and formed at the upper portion of the gear case holder 38. Through the insertion holes 41 a support shaft 42 is inserted. The support shaft 42 has a stopper 43 secured to its end projecting from the insertion hole 41. The support shaft 42 supports at the projecting portion the upper part of a first actuating arm 44 and an intermediate portion of a second actuating arm 45 in such a way that these two arms can be rotated to the right and left with respect to the toy figure. The first actuating arm 44 has an insertion hole 46 at the upper end through which the support shaft 42 is rotatably inserted. The arm 44 also has an outwardly and horizontally extending projection 47 formed below the insertion hole 46. The first actuating arm 44 also has an arm 48 extending downwardly from the projection 47, with an actuating portion 49 at the lower end of the arm 48 being retractably inserted in the guide slot 3 of the skateboard 1 and engaged with the engagement piece 24 of the steering rod 22. Oscillation of the first actuating arm 44 about the support shaft 42 to right and left causes the steering rod 22 to be advanced against the coil spring 26 or retracted by it. Since the movable frame 27 is horizontally rotatable about the boss 5 and the steering rod 22 is normally axially retracted by the coil spring 26, the front wheels 32, 32 on each side are tilted to one side with respect to the skateboard advancing direction at a certain angle. The second actuating arm 45 has at an intermediate portion a horizontal guide slot 50 which is elongate to the right and left and through which the support shaft 42 is inserted. Below this guide slot 50 is formed an insertion hole 51 through which the projection 47 of the first actuating arm 44 is rotatably inserted. The second actuating arm 45 has a mounting hole 52 at the lower end. At the upper end of the second actuating arm 45 an interlocking pin 53 is vertically projected.

On a top plate 54 of the gear case holder 38 is vertically erected a rotating center shaft 56 which has a spacer 55 at its lower portion. Mounted horizontally rotatably on a part of the rotating center shaft 56 which projects from the spacer 55 is a rotatable frame 57 that is supported at the central portion of its top plate 58. At the front part of the top plate 58 the rotating frame 57 has an insertion hole 59 through which the interlocking pin 53 of the second actuating arm 45 is rotatably inserted. At the front and rear lower portions of side wall plates 60, the rotating frame 57 has engagement projections 61, 61, 61, 61 on each side projecting horizontally to the front and rear. The part of the rotating center shaft 56 projecting from the top plate 58 of the rotating frame 57 has a stopper 63 at its upper end through a spacer 62. The rotating frame 57 is horizontally rotated to the left and right about the rotating center shaft 56 by the left and right oscillation of the second actuating arm 45.

An output shaft 64 is rotatably supported longitudinally at the lower part of the gear case 40. The output shaft 64 has a drive spring 65 whose internal engagement portion 66 is fixed to an engagement portion of an intermediate part of the output shaft 64. The external engagement portion 67 of the drive spring 65 wound on the output shaft 64 is engaged with an engagement portion of the gear case 40. The output shaft 64 has an output gear 68 secured thereto at an intermediate portion. A cam plate 69 of almost diamond shape, which is engaged with the arm 48 of the first actuating arm 44, is securely mounted on the output shaft 64 near one end. On the other end of the output shaft 64 projecting from the back of a body (described later), a thumb wheel 70 with serration for preventing slippage is securely fixed. The output shaft 64, the drive spring 65, the output gear 68 and the cam plate 69 combine to form an output mechanism 102.

In the lower part of the gear case 40 a rotating shaft 71 is rotatably supported. The rotating shaft 71 has at one end a gear 72 in mesh with the output gear 68 and at the other end a reduction gear 73 in mesh with the drive gear 15 of the wheel shaft 13. The output gear 68, the rotating shaft 71, the gear 72, the reduction gear and the drive gear 15 combine to form a gear mechanism 74 that drives the wheel 14.

In the upper part of the gear case 40 a rotating shaft 75 is rotatably supported. The oscillating shaft 75 has a brake gear 76 and a gear 77 secured thereto. The gear 77 is in mesh with an intermediate gear 78, and a pinion 79 coaxial with the intermediate gear 78 is in mesh with the output gear 68. In the gear case 40 an oscillating frame 81 of synthetic resin is supported on a shaft 80 so that it is oscillated with respect to the brake gear 76. At the lower ends of side frame pieces 82, 82 provided on each side of the oscillating frame 81, there is a pair of inwardly protruding projections 83 that come into and out of engagement with the brake gear 76 as the brake gear 76 is rotated. Between the right and left side frame pieces 82, 82 is formed a slot 85 in the side plate 84 through which one end of the rotating shaft 75 is inserted. The rotating shaft 75, the brake gear 76, the gear 77, the intermediate gear 78, the pinion 79, and the oscillating frame 81 with the projections 83, 83 together form a brake mechanism 86 that controls the rotation of the output gear 68.

At the lower part of the gear case holder 38, lower body frames 87, 87 that are separated and form the front and rear halves of the lower body are combined together and connected to the front and rear sides of the gear case holder 38 by screws. Flanges 88, 88 at the lower ends of the front and rear lower body frames 87, 87 are fitted into front and rear gaps formed by the spacer 37 interposed between the mounting pieces 39, 39, on each side, of the gear case holder 38 and the skateboard 1. The front lower body frame 87 has leg frames 89, 89 on each side integrally molded therewith which are placed on the skateboard 1. The rear lower body frame 87 has the thumb wheel 70 of the output shaft 64 projecting from the back through a guide hole not shown. The front and rear lower body frames 87, 87 form a stationary body 90 fixed to the stakeboard 1.

Divided front and rear upper body frames 91, 91 are disposed longitudinally opposing each other at the front and back of the rotating frame 57, with engagement portions of the upper body frames 91, 91 engaged with the engagement projections 61, 61, 61, 61, at the back and front on each side, of the rotating frame 57. The front and rear upper body frames 91, 91 have opposing projecting screw cylinders 92, 92, 92, 92 which are coupled together by screws. At upper parts of the front and rear upper body frames 91, 91 are formed bearings 93, 93 in which mounting shafts 95, 95 for left and right arms 94, 94 are rotatably mounted. The left and right mounting shafts 95, 95 have flanges 96, 96 at the inner ends to prevent the shafts from getting dislocated. Head frames 97, 97, which are divided into the front and rear portions, are molded on upper parts of the front and rear upper body frames 91, 91 on the front head frame 97 is formed a face frame 98. The front and rear upper body frames 91, 91 form a movable body 99 that rotates with respect to the stationary body 90. The movable body 99 has the arms 94, 94 on each side. The front and rear head frames 97, 97 form a head 100. The stationary body 90 and the movable body 99 with the left and right arms 94, 94 and the head 100 form a toy body 101 made to resemble a gorilla riding on the skateboard 1.

Now, the action of the toy with the above construction will be explained.

First, the thumb wheel 70 is held by fingers and rotated a desired number of turns in the direction of winding up the drive spring 65. As a result, the output shaft 64 is rotated and the drive spring 65 is wound up on the output shaft 64.

When, after the drive spring 65 is charged, the fingers are released from the thumb wheel 70, the drive spring 65 automatically unwinds to rotate the output shaft 64 as well as the output gear 68 and cam plate 69 rigidly mounted on the shaft 64.

The rotation of the output gear 68 is transmitted to the gear 72, reduction gear 73, drive gear 15, wheel shaft 13 and the wheel 14. As the wheel 14 is turned, the skateboard 1 on which the animal toy 101 is placed sideways starts moving straight.

As the cam plate 69 is rotated, it pushes the arm 48 of the first actuating arm 44 intermittently to the right and left, causing the first actuating arm 44 to oscillate to the right and left about the support shaft 42. At the same time, the actuating portion 49 at the lower end of the arm 48 intermittently pushes the engagement piece 24 of the steering rod 22 against the force of the coil spring 26, with the result that the steering rod 22 is slowly advanced and retracted to the right and left. As the steering rod 22 advances and retracts, the movable frame 27 is rotated horizontally about the boss 5 of the skateboard 1 and at the same time the front wheels 32, 32 at each end of the wheel shaft 31 supported on the horizontal bearing 30 are slowly turned horizontally to the right and left, alternately, with respect to the advancing direction.

Because the wheel 14 tends to drive the skateboard 1 straight ahead and the front wheels 32, 32 are horizontally turned toward the right and left alternately by the steering rod 22 as the skateboard is driven, the skateboard 1 runs in a zigzag path.

When the first actuating arm 44 is oscillated to the right and left, the projection 47 of the first actuating arm 44 actuates the second actuating arm 45 through the insertion hole 51, so that the second actuating arm 45 oscillates to the right and left about the output shaft 64. At the same time, the interlocking pin 53 at the top of the second actuating arm 45 slowly drives, through the insertion hole 59, the rotating frame 57 to the right and left horizontally about the rotating center shaft 56. As the rotating frame 57 is oscillated, the movable body 99 mounted on the rotating frame 57 through the engagement projections 61, 61, 61, 61 is slowly turned to the right and left horizontally and alternately along with the rotating frame 57, with the stationary body 90 remaining motionless on the skateboard 1. In more detail, when the movable body 99 is turned to the right, the front wheels 32, 32 on each side is steered toward the right causing the skateboard 1 to curve to the right. When the movable body 99 is turned toward the left, the front wheels 32, 32 are steered toward the left, steering the skateboard 1 toward the left. The above right and left steering actions are repeated.

The toy body 101 riding sideways on the skateboard 1 twists the upper half of its body while steering the skateboard 1 in a zigzag line as if the toy animal were enjoying the skateboarding.

The left and right arms 94, 94 are shown hanging on its sides. In the above action, one or both of these arms 94, 94 may be rotated to the raised position or to the front or back position and then set there, so that with the raised arms 94, 94 the toy animal 101 looks as if it were balancing on its skateboard 1 while skateboarding in a snaking path.

The skateboard 1 is run usually on the intermediate wheel 14 and the front wheels 32, 32 on each side. This skateboard 1 may run using also the rear wheels 35, 35 on each side.

When the charged spring 65 unwinds and the rotation of the output gear 68 is transmitted to the meshing gear 72, the rotation is restricted by the brake mechanism 86 so that the output gear 68 is smoothly rotated at a constant speed. That is, as the output gear 68 is rotated, this rotation is transmitted through the pinion 79, the intermediate gear 78 and the gear 77 to the brake gear 76. The brake gear 76 comes into and out of engagement with the internal projections 83, 83 of the oscillating frame 81 that oscillates back and forth about the support shaft 80 as the brake gear 76 rotates. The engagement with internal projections 83, 83 restrains the rotation of the brake gear 76 and this restraining action is applied to the output gear 68 through the gear 77, the intermediate gear 78 and the pinion 79. As a result, the output gear 68 will not be driven irregularly by the unwinding drive spring 65 and will be rotated smoothly at a constant speed. This keeps the toy body 101 and the skateboard 1 from changing their speeds greatly, thus assuring a smooth skateboarding action.

While in this embodiment the toy body 101 is formed to resemble a gorilla, any kind of animal may be used. It may also be a doll.

The output mechanism is not limited to a drive spring as used in the above embodiment and may employ an electric motor.

[Effect of the Invention]

Since the toy according to this invention has the toy animal mounted horizontally rotable, through the mechanism frame, on the skateboard which has the drive wheel and the steering front wheels, the toy body looks as if it were riding on the skateboard. The first actuating arm which is rotatably mounted on the mechanism frame to steer the front wheels through the steering rod, enables the skateboard to be reliably driven along a snaking path as the output mechanism drives the drive wheel and the first actuating arm. The second actuating arm which is rotatably mounted on the mechanism frame to oscillate the toy body permits the toy body to be reliably twisted horizontally while the skateboard is being driven along a zigzag path as the output mechanism drives the second actuating arm. The simultaneous operation of the first and second actuating arms and the drive wheel by the output mechanism makes it possible to coordinate the snaking motion of the skateboard with the twisting motion of the riding toy animal, thus making the toy body look as if it were keeping a balance on the skateboard while steering it toward the left and right. In this way, this invention can provide a skateboarding toy which performs interesting skateboarding actions as if it were enjoying the skateboarding.

What is claimed is:

1. A skate-boarding toy comprising:

a skateboard (1) having top, bottom, front, rear, and side portions, a drive wheel (14) mounted adjacent said rear portion and steerable wheels rotatably mounted adjacent said front portion;

a mechanism frame (38) fixedly mounted on said top portion of said skateboard and having a vertical axis;

a rotating frame (57) mounted on said mechanism frame for rotation about said vertical axis;

a toy body (99) mounted on said skateboard to face toward said side portion and including a lower body frame (90) surrounding said mechanism frame in fixed relation thereto, and an upper body frame (91) mounted on said rotatable frame for rotation therewith;

an output mechanism (102) mounted on said mechanism frame and having a power output (64);

a first actuating arm (44) rotatably mounted on said mechanism frame and connected to be driven by said power output;

a steering rod (22) mounted on said skateboard and operatively connected between said first actuating arm and said steerable wheels to steer the latter; and a second actuating arm (45) rotatably mounted on said mechanism frame and connected between said rotating frame and said power output to rotate said rotating frame simultaneously with steering movement of said steerable wheels.

2. A skateboarding toy according to claim 1 wherein said mechanism frame has a support shaft (42) and said first and second actuating arms are both mounted for oscillating movement about said support shaft.

3. A skateboarding toy according to claim 1 wherein;

said steerable wheels are mounted on said skateboard for movement between two positions, a wheel case (6) is mounted on said bottom portion of said skateboard, said drive wheel (14) is rotatably mounted on said wheel case, said steering rod (22) has two end portions (23, 24) and is mounted in said wheel case, with one of said end portions (23) connected to said front steerable wheels and the other of said end portions (24) connected to said first actuating arm, and a spring means (26) mounted in said wheel case to constantly bias said steerable wheels toward one of said two positions.

4. A skateboarding toy according to claim 1, 2 or 3 wherein;

said output mechanism includes a rotating cam plate (69), and said first actuating arm has a projection (47) connected to said second actuating arm and an actuating portion (49) for intermittent engagement with said cam plate.

5. A skateboarding toy according to claim 1, 2 or 3 wherein;

said power output includes a shaft (64) rotatably mounted on said mechanism frame, a cam plate (69) mounted on said shaft, an output gear (68) mounted on said shaft, and a drive spring (65) mounted on said shaft and connected to said mechanism frame for rotating said shaft, said cam plate is connected to intermittently contact said first actuating arm, and said output gear is connected to drive said drive wheel.

6. A skateboarding toy according to claim 1, 2 or 3 wherein;

said fixed mechanism frame has a center shaft (56) rotatably mounted to extend vertically therefrom, and said rotatable frame is fixedly mounted on said center shaft.

* * * * *